US010889124B2

(12) United States Patent
Oguchi et al.

(10) Patent No.: US 10,889,124 B2
(45) Date of Patent: Jan. 12, 2021

(54) LIQUID EJECTING APPARATUS

(71) Applicant: SEIKO EPSON CORPORATION, Tokyo (JP)

(72) Inventors: Ryo Oguchi, Shiojiri (JP); Yasuaki Hirai, Shiojiri (JP)

( * ) Notice: Subject to any disclaimer, the term of this patent is extended or adjusted under 35 U.S.C. 154(b) by 0 days.

(21) Appl. No.: 16/552,607

(22) Filed: Aug. 27, 2019

(65) Prior Publication Data

US 2020/0070509 A1 Mar. 5, 2020

(30) Foreign Application Priority Data

Aug. 28, 2018 (JP) ..... 2018-159289

(51) Int. Cl.

*B41J 2/175* (2006.01)
*B41J 2/19* (2006.01)
*B41J 2/045* (2006.01)

(52) U.S. Cl.

CPC ..... *B41J 2/17566* (2013.01); *B41J 2/17546* (2013.01); *B41J 2/19* (2013.01); *B41J 2/04551* (2013.01); *B41J 2/04586* (2013.01); *B41J 2002/17573* (2013.01); *B41J 2002/17589* (2013.01)

(58) Field of Classification Search

CPC ..... B41J 2/17566; B41J 2/19; B41J 2/17546; B41J 2002/17573; B41J 2002/17589; B41J 2/04551; B41J 2/04586

See application file for complete search history.

(56) References Cited

U.S. PATENT DOCUMENTS

2002/0191042 A1* 12/2002 Paul ..... B41J 2/17566 347/22
2006/0250425 A1* 11/2006 Nambudiri ..... B41J 2/17566 347/7
2016/0063900 A1 3/2016 Gorelik et al.
2016/0101629 A1* 4/2016 Sawase ..... B41J 2/175 347/7
2017/0087866 A1* 3/2017 Bhaskaran ..... B41J 2/17546

FOREIGN PATENT DOCUMENTS

JP 2004-237595 8/2004
JP 2004-322437 11/2004
JP 2005-231246 9/2005
JP 2008-149587 7/2008
JP 2016-168723 9/2016

* cited by examiner

*Primary Examiner* — Justin Seo

(57) ABSTRACT

A liquid ejecting apparatus includes a liquid ejecting head that ejects a liquid accommodated in a liquid container, a detection unit that detects a remaining amount of the liquid accommodated in the liquid container, and a control unit that operates in a normal mode and a special mode. In the normal mode, the control unit prohibits ejection of the liquid from the liquid ejecting head when the detection unit has detected that the remaining amount of the liquid accommodated in the liquid container has become smaller than a predetermined threshold value. In the second mode, the control unit allows ejection of the liquid from the liquid ejecting head with an instruction from a user as a requirement when the detection unit has detected that the remaining amount of the liquid accommodated in the liquid container has become smaller than the predetermined threshold value.

7 Claims, 3 Drawing Sheets

LIQUID EJECTING APPARATUS

The present application is based on, and claims priority from JP Application Serial Number 2018-159289, filed Aug. 28, 2018, the disclosure of which is hereby incorporated by reference herein in its entirety.

BACKGROUND

1. Technical Field

The present disclosure relates to a liquid ejecting apparatus.

2. Related Art

For example, a liquid ejecting apparatus described in JP-A-2016-168723 is configured such that the remaining amount of a liquid accommodated in a liquid container is detected by a sensor incorporated in the liquid container and a user is prompted to replenish the liquid when the remaining amount of the liquid has become smaller than a predetermined amount.

However, in the apparatus described in the document above, the liquid still remains in the apparatus at the time when the remaining amount of the liquid accommodated in the liquid container becomes smaller than the predetermined amount. Therefore, there is still a room for improvement in terms of efficient usage of the liquid.

SUMMARY

A liquid ejecting apparatus according to an aspect includes a liquid ejecting head that ejects a liquid accommodated in a liquid container, a detection unit that detects a remaining amount of the liquid accommodated in the liquid container, and a control unit that operates in a first mode and a second mode. In the first mode, the control unit prohibits ejection of the liquid from the liquid ejecting head when the detection unit has detected that the remaining amount of the liquid accommodated in the liquid container has become smaller than a predetermined threshold value. In the second mode, the control unit allows ejection of the liquid from the liquid ejecting head with an instruction from a user as a requirement when the detection unit has detected that the remaining amount of the liquid accommodated in the liquid container has become smaller than the predetermined threshold value.

DESCRIPTION OF EXEMPLARY EMBODIMENTS

An embodiment in which a liquid ejecting apparatus is specified as an ink jet printing apparatus will be described below with reference to drawings.

Figure 1:
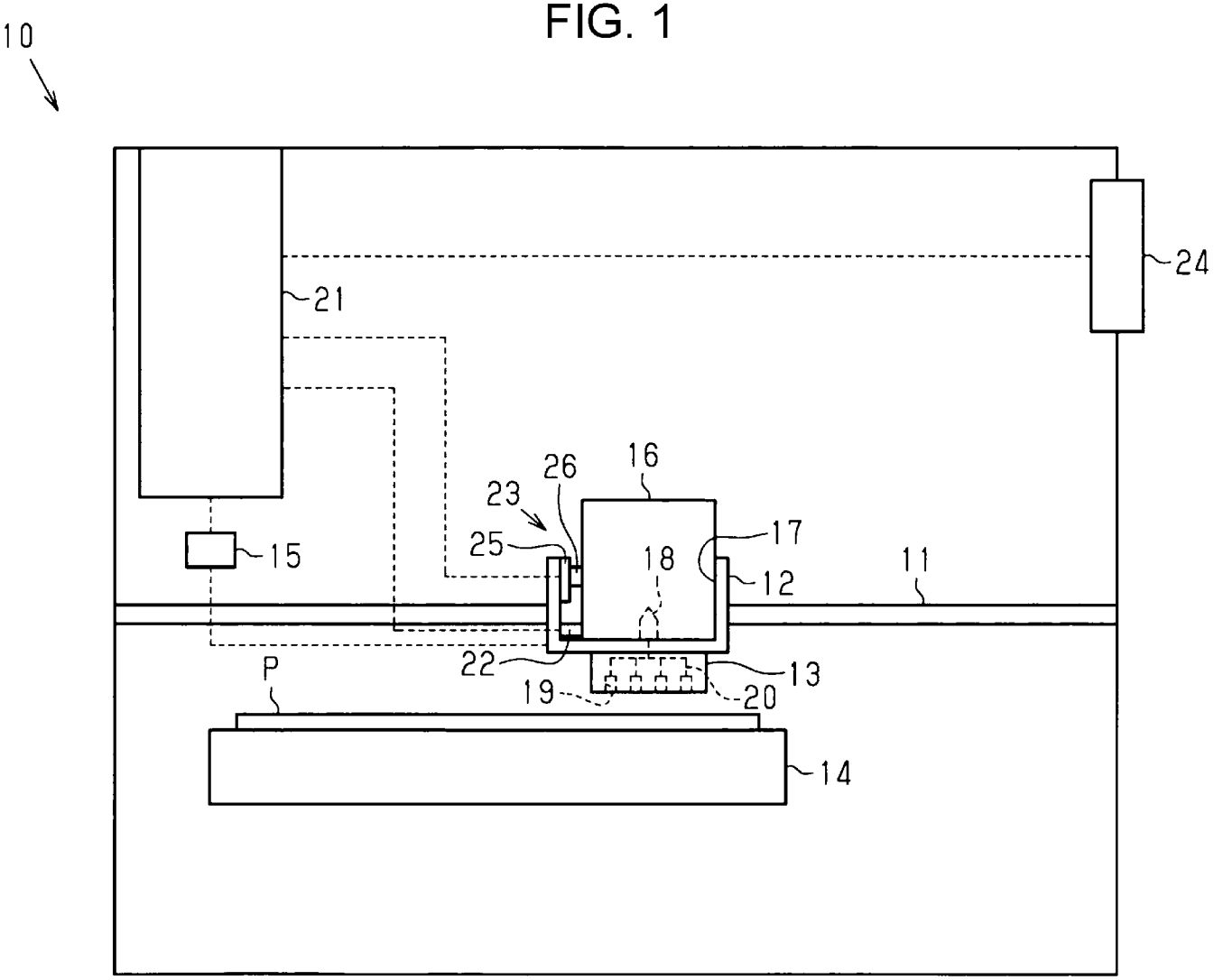
FIG. 1 is a schematic diagram illustrating an embodiment of a liquid ejecting apparatus.

As illustrated in FIG. 1, the ink jet printing apparatus (hereinafter referred to as a "printing apparatus") 10 of the present embodiment includes a carriage 12 and a printing head 13. The carriage 12 is provided to be capable of reciprocating along a guide shaft 11. The printing head 13 is provided on the carriage 12, ejects an ink toward a medium P, and serves as an example of a liquid ejecting head that performs so-called printing. Further, the printing apparatus 10 includes a support stage 14 that supports the medium P, and a carriage motor 15 serving as a drive source for moving the carriage 12.

In addition, the carriage 12 is provided with an attachment portion 17 to which at least one ink container 16 can be attached. That is, the printing apparatus 10 of the present embodiment is an apparatus of a so-called on-carriage type in which the carriage 12 reciprocates the attachment portion 17 and the printing head 13 along a movement direction (horizontal direction in FIG. 1). When a plurality of ink containers 16 are attached to the carriage 12, each ink container 16 may accommodate a liquid of a different kind. Examples of liquids of different kinds include inks of different colors such as black, cyan, magenta, and yellow.

The attachment portion 17 is provided with at least one (for example, the same number as the number of ink containers 16 that can be attached to the attachment portion 17) supply needle 18 that is inserted in the ink container 16 attached to the attachment portion 17. Further, the printing head 13 includes a plurality of nozzles 19 for ejecting the ink toward the medium P, and a communication channel 20 through which the nozzles 19 and the supply needle 18 communicate with each other formed therein. Therefore, when the ink container 16 is attached to the attachment portion 17, the ink accommodated in the ink container 16 is supplied to the nozzles 19 through the supply needle 18 and the communication channel 20. To be noted, the ink container 16 is detachably attached to the attachment portion 17.

Next, an electrical configuration of the printing apparatus 10 and the ink container 16 will be described.

As illustrated in FIG. 1, the printing apparatus 10 includes a control unit 21 that controls driving of the carriage motor 15 and the printing head 13 for ejecting the ink onto the medium P to perform printing. In addition, the printing apparatus 10 includes an ink remainder sensor 22 and an attachment sensor 23. The ink remainder sensor 22 serves as an example of a detection unit that detects the remaining amount of the ink accommodated in the ink container 16, and the attachment sensor 23 detects attachment of the ink container 16 to the attachment portion 17. In addition, the printing apparatus 10 includes a notification unit 24 that issues a notification prompting replacement of the ink container 16, switching of the printing mode of the printing apparatus 10, and disposal of the printing apparatus 10 when the remaining amount of the ink accommodated in the ink container 16 is insufficient.

The ink remainder sensor 22 is provided on the carriage 12, and moves according to the movement of the carriage 12. In addition, for example, the ink remainder sensor 22 is a photoelectric sensor including a light emitting element and a light receiving element, and detects the remaining amount of ink based on the intensity of reflection light changing according to the remaining amount of the ink accommodated in the ink container 16.

The attachment sensor 23 includes an electrical coupling portion 25 that is provided in the attachment portion 17 and moves with the carriage 12. To be noted, the electrical coupling portion 25 is provided in the same number as the number of ink containers 16 that can be attached to the attachment portion 17 (for example, four). In addition, the electrical coupling portion 25 is a circuit that transmits a signal indicating the type of the ink container 16 to the control unit 21 when the ink container 16 is attached to the attachment portion 17.

The ink container 16 includes a semiconductor device 26. The semiconductor device 26 can be electrically coupled to the electrical coupling portion 25 by contacting the electrical coupling portion 25. That is, in a state in which the ink container 16 is attached to the attachment portion 17 and the ink can be supplied to the printing head 13, the semiconductor device 26 is in contact with the electrical coupling portion 25. Then, when the semiconductor device 26 is in contact with the electrical coupling portion 25, identification information is transmitted to the control unit 21 through the electrical coupling portion 25. Then, the control unit 21 determines, based on a signal transmitted from the semiconductor device 26, whether or not the ink container 16 has been attached to the attachment portion 17.

The notification unit 24 is constituted by, for example, a liquid crystal display that functions as a touch panel. The notification unit 24 is electrically coupled to the control unit 21, and changes a display content according to a signal transmitted from the control unit 21. More specifically, the notification unit 24 displays a display screen prompting replacement of the ink container 16, switching of the printing mode of the printing apparatus 10, or the like when the control unit 21 has determined that the remaining amount of the ink accommodated in the ink container 16 is insufficient based on a signal input from the ink remainder sensor 22. To be noted, in the present embodiment, a normal mode serving as an example of a first mode and a special mode serving as an example of a second mode are included as printing modes executed when the remaining amount of the ink in the ink container 16 is insufficient. The normal mode is a mode in which ejection of the ink from the printing head 13 is prohibited. The special mode is a mode in which ejection of the ink from the printing head 13 is allowed with an instruction from a user as a requirement. To be noted, in the special mode, the total amount of ink allowed to be ejected from the printing head 13 is restricted to a predetermined amount. This predetermined amount is set as a value larger than the remaining amount of the ink remaining in the ink container 16 at the time when the ink remainder sensor 22 detects insufficiency of the remaining amount of the ink accommodated in the ink container 16 and smaller than the sum of the remaining amount of the ink remaining in the ink container 16 at the time of the same detection and the remaining amount of the ink remaining in the channel from the ink container 16 to the printing head 13. Therefore, even if the ink is ejected from the printing head 13 under the condition of the special mode, ejection from the printing head 13 with ink shortage can be avoided. To be noted, in the special mode, the control unit 21 starts counting the amount of ink ejected from the printing head 13, at the time when the ink remainder sensor 22 detects the insufficiency of the remaining amount of the ink accommodated in the ink container 16. Then, the control unit 21 allows ejection of the ink from the printing head 13 until the count value of the amount of ink reaches the predetermined amount. In addition, when an operation for transitioning the printing mode of the printing apparatus 10 to the special mode is received from a user, the notification unit 24 transmits a signal instructing to switch the printing mode to the control unit 21. Further, for example, when various operations such as an operation to dispose of the printing apparatus 10 and an operation to cancel the special mode of the printing apparatus 10 are received from the user, the notification unit 24 transmits a signal instructing the operation from the user to the control unit 21.

Next, a printing mode switching routine will be described with reference to a flowchart shown in FIG. 2. To be noted, this printing mode switching routine is regularly executed while the power of the printing apparatus 10 is on, for example, when the power of the printing apparatus 10 is turned on and before the printing is started.

Figure 2:
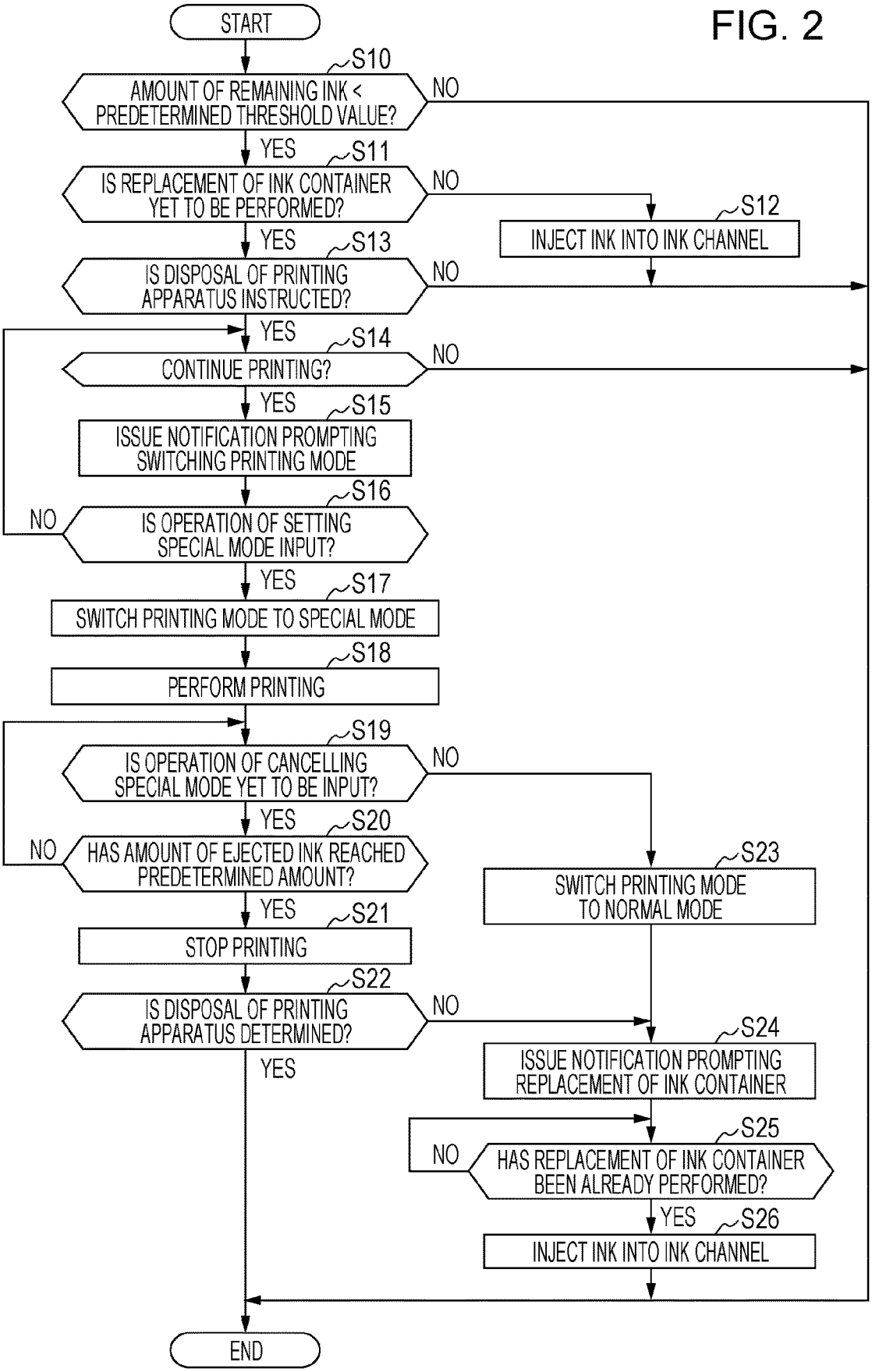
FIG. 2 is a flowchart illustrating a printing mode switching routine.

As illustrated in FIG. 2, in step S10, the control unit 21 determines, based on the signal input from the ink remainder sensor 22, whether or not the remaining amount of ink is smaller than a predetermined threshold value. To be noted, a value when the remaining amount of the ink accommodated in the ink container 16 is insufficient is set as the predetermined threshold value.

Then, when the remaining amount of ink is equal to or larger than the predetermined threshold value (step S10: NO), the control unit 21 finishes the printing mode switching routine. In addition, when the remaining amount of ink is smaller than the predetermined threshold value (step S10: YES), in step S11, the control unit 21 determines, based on a signal input from the attachment sensor 23, whether or not replacement of the ink container 16 is yet to be performed.

When the replacement of the ink container 16 has been already performed (step S11: NO), in step S12, the control unit 21 finishes the printing mode switching routine after pouring the ink accommodated in the replaced ink container 16 into the ink channel. In addition, when replacement of the ink container 16 is yet to be performed (step S11: YES), in step S13, the control unit 21 determines, based on a signal input from the notification unit 24, whether or not disposal of the printing apparatus 10 has been instructed by a user.

Then, when disposal of the printing apparatus 10 has not been instructed (step S13: NO), the control unit 21 finishes the printing mode switching routine. In addition, when disposal of the printing apparatus 10 has been instructed (step S13: YES), in step S14, the control unit 21 determines, based on a signal input from the notification unit 24, whether or not continuation of printing has been instructed by a user.

Then, when continuation of printing has not been instructed (step S14: NO), the control unit 21 finishes the printing mode switching routine. When continuation of printing has been instructed (step S14: YES), in step S15, the control unit 21 issues a notification to prompt switching of the printing mode by transmitting a control signal to the notification unit 24. In addition, in step S16, the control unit 21 determines, based on a signal input from the notification unit 24, whether or not a setting operation for the special mode has been input from a user.

Then, when the setting operation for the special mode has not been input (step S16: NO), the control unit 21 returns the process back to step S14, and repeats processing of steps S14 to S16 until the setting operation for the special mode is input. When the setting operation for the special mode has been input (step S16: YES), in step S17, the control unit 21 switches the printing mode of the printing apparatus 10 to the special mode. In this case, according to the switching of the printing mode, the control unit 21 stops the comparative determination between the remaining amount of ink input from the ink remainder sensor 22 and the predetermined threshold value. Then, in step S18, the control unit 21 transmits a control signal to the printing head 13 under the condition of the special mode to perform printing. In addition, in step S19, the control unit 21 determines, based on a signal input from the notification unit 24, whether or not a cancellation operation for the special mode is yet to be input.

When the cancellation operation for the special mode is yet to be input (step S19: YES), in step S20, the control unit 21 determines whether or not the total amount of ink ejected from the printing head 13 since switching of the printing mode to the special mode has reached the predetermined amount.

When the total amount of ink ejected from the printing head 13 has not reached the predetermined amount (step S20: NO), the control unit 21 returns the process back to step S19, and repeats the processing of steps S19 and S20 until the total amount of ink ejected from the printing head 13 reaches the predetermined amount. In addition, when the total amount of ink ejected from the printing head 13 has reached the predetermined amount (step S20: YES), in step S21, the control unit 21 transmits a control signal to the printing head 13 to stop printing. In addition, in step S22, the control unit 21 determines, based on a signal input from the notification unit 24, whether or not an instruction to determine disposal of the printing apparatus 10 has been input from a user. Then, when the instruction to determine disposal of the printing apparatus 10 has been input (step S22: YES), the control unit 21 finishes the printing mode switching routine.

When it has been determined in step S19 that the cancellation operation for the special mode has been input (step S19: NO), in step S23, the control unit 21 switches the printing mode of the printing apparatus 10 to the normal mode. In addition, in step S24, the control unit 21 issues a notification prompting replacement of the ink container 16 by transmitting a control signal to the notification unit 24. To be noted, the control unit 21 also issues the notification prompting replacement of the ink container 16 by transmitting a control signal to the notification unit 24 in step S24 when it has been determined in step S22 described above that the instruction to determine disposal of the printing apparatus 10 has not been input (step S22: NO).

Then, when replacement of the ink container 16 is not performed (step S25: NO), the control unit 21 stands by, based on a signal input from the attachment sensor 23, until replacement of the ink container 16 is performed. When the replacement of the ink container 16 has been already performed (step S25: YES), in step S26, the control unit 21 finishes the printing mode switching routine after pouring the ink accommodated in the replaced ink container 16 into the ink channel.

In the printing mode switching routine described above, steps S14 to S16 may be omitted, and the process may proceed to step S17 when the result of step S13 is YES. In addition, step S22 may be omitted by enabling cancelling the special mode and switching to the normal mode any time.

Next, an action of the printing apparatus 10 of the present embodiment will be described.

Generally, when the remaining amount of the ink accommodated in the ink container 16 is insufficient, ejection of the ink from the printing head 13 is normally prohibited unless the ink container 16 is replaced to avoid ejection of ink from the printing head 13 with ink shortage. However, at the time when the ink remainder sensor 22 detects insufficiency of the remaining amount of the ink accommodated in the ink container 16, a small amount of ink still remains in the ink container 16. Therefore, when disposing of the printing apparatus 10, the small amount of ink still remains in the ink container 16, and thus there is still a room for improvement in terms of efficient usage of ink.

In this point, according to the present embodiment, as printing modes of the printing apparatus 10 executed when the remaining amount of the ink accommodated in the ink container 16 is insufficient, the special mode in which ejection of the ink from the printing head 13 is allowed under a predetermined restrictive condition is included in addition to the normal mode in which ejection of the ink from the printing head 13 is prohibited. Further, when transition from the normal mode to the special mode is instructed by the user, the ink accommodated in the ink container 16 is continuously used for the printing on the medium P even after the ink remainder sensor 22 has detected insufficiency of the remaining amount of ink. Therefore, the remaining amount of the ink remaining in the ink container 16 when disposing of the printing apparatus 10 can be reduced, and the ink can be efficiently used as a result.

In addition, in the present embodiment, even after switching the printing mode of the printing apparatus 10 from the normal mode to the special mode, cancelling the special mode and switching to the normal mode are allowed until disposal of the printing apparatus 10 is determined. Therefore, there are more opportunities to efficiently use the printing apparatus 10 without disposing of the printing apparatus 10.

According to the embodiment described above, the following effects can be achieved.

(1) The control unit 21 includes, as printing modes executed when the ink remainder sensor 22 has detected that the remaining amount of the ink accommodated in the ink container 16 has become smaller than the predetermined threshold value, the normal mode in which ejection of the ink from the printing head 13 is prohibited and the special mode in which ejection of the ink from the printing head 13 is allowed with an instruction from a user as a requirement. Therefore, even when the remaining amount of ink is insufficient, by the switching of the printing mode, the printing can be continuously performed by using the ink accommodated in the ink container 16, and thus the ink can be efficiently used.

(2) The control unit 21 controls notification by the notification unit 24 to prompt an operation of transitioning from the normal mode to the special mode when the ink remainder sensor 22 has detected that the remaining amount of the ink accommodated in the ink container 16 has become smaller than the predetermined threshold value. Therefore, when the remaining amount of ink is insufficient, the user can be notified that the printing mode needs to be switched, and thus the printing mode can be quickly switched.

(3) When the printing mode has transitioned from the normal mode to the special mode, the control unit 21 stops the comparative determination between the remaining amount of ink detected by the ink remainder sensor 22 and the predetermined threshold value. Therefore, processing load on the control unit 21 executing the printing mode switching routine can be reduced.

(4) When the printing mode has transitioned from the normal mode to the special mode, the control unit 21 sets the total amount of the ink allowed to be ejected from the printing head 13 to the predetermined amount. Therefore, even when the remaining amount of the ink accommodated in the ink container 16 is insufficient, printing can be continued while avoiding ejection of the ink from the printing head 13 with ink shortage.

(5) The predetermined amount is set as a value larger than the predetermined threshold value. Therefore, the control unit 21 can more efficiently use the ink remaining in the ink container 16 when the remaining amount of the ink accommodated in the ink container 16 is insufficient.

(6) In the case where a predetermined cancellation operation is received during the special mode, the control unit 21 cancels the special mode and switches to the normal mode. Therefore, there are more opportunities to efficiently use the printing apparatus 10 without disposing of the printing apparatus 10.

(7) When the special mode has been cancelled and switched to the normal mode, the control unit 21 pours the ink accommodated in the replaced ink container 16 into the ink channel extending from the ink container 16 to the printing head 13. Therefore, even if the ink is ejected from the printing head 13 when the remaining amount of the ink in the ink container 16 is insufficient and thus an air bubble enters the ink channel extending from the ink container 16 to the printing head 13, the air bubble can be removed from the ink channel to maintain the printing quality.

To be noted, the embodiment described above may be modified as in modification examples shown below. Further, an appropriate combination of the embodiment described above and the modification examples shown below may be an additional modification example, and an appropriate combination of the modification examples shown below may be an additional modification example.

Figure 3A:
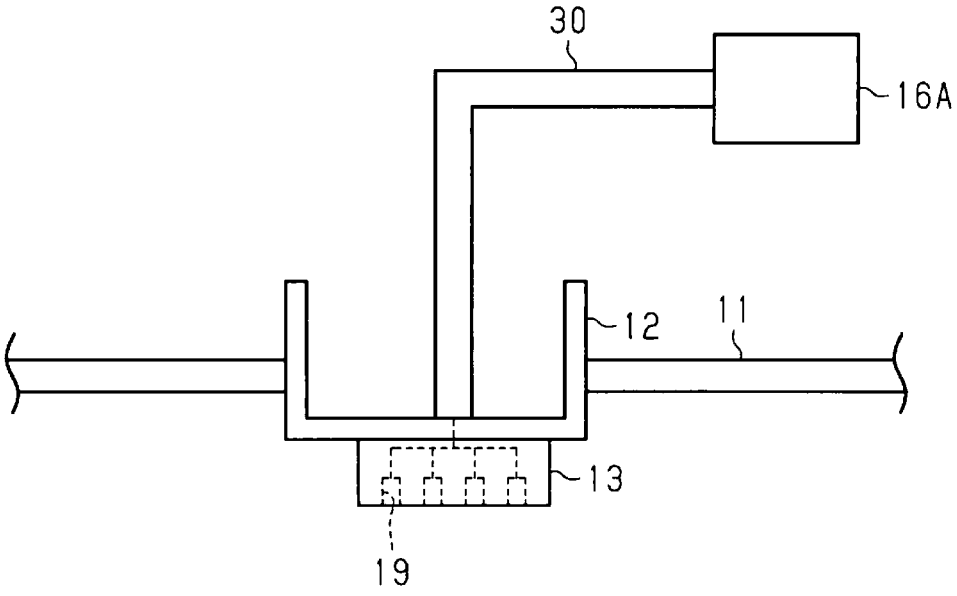
FIGS. 3A and 3B are schematic diagrams illustrating other embodiments of the liquid ejecting apparatus.

In the embodiment described above, the present disclosure may be applied to an apparatus of a so-called off-carriage type in which the printing head 13 mounted on the carriage 12 is coupled to an ink container 16A via an ink channel 30 instead of mounting the ink container 16A on the carriage 12 as illustrated in FIG. 3A. To be noted, the ink container 16A may be of a cartridge type that is replaceable, or a tank type that can be replenished with the ink through an ink pour. When the ink container 16A is of a tank type, the control unit 21 may pour the ink accommodated in the ink container 16A into the ink channel 30 extending from the ink container 16A to the printing head 13 with the ink container 16A being replenished with the ink and the remaining amount of ink becoming equal to or larger than the predetermined threshold value as a requirement after the printing mode of the printing apparatus 10 has been switched from the special mode to the normal mode. In addition, the ink remainder sensor 22 may be provided in the ink container 16A, at a position adjacent to the ink container 16A in the printing apparatus 10, or at a position in the middle of the ink channel 30 extending from the ink container 16A to the printing head 13.

Figure 3B:
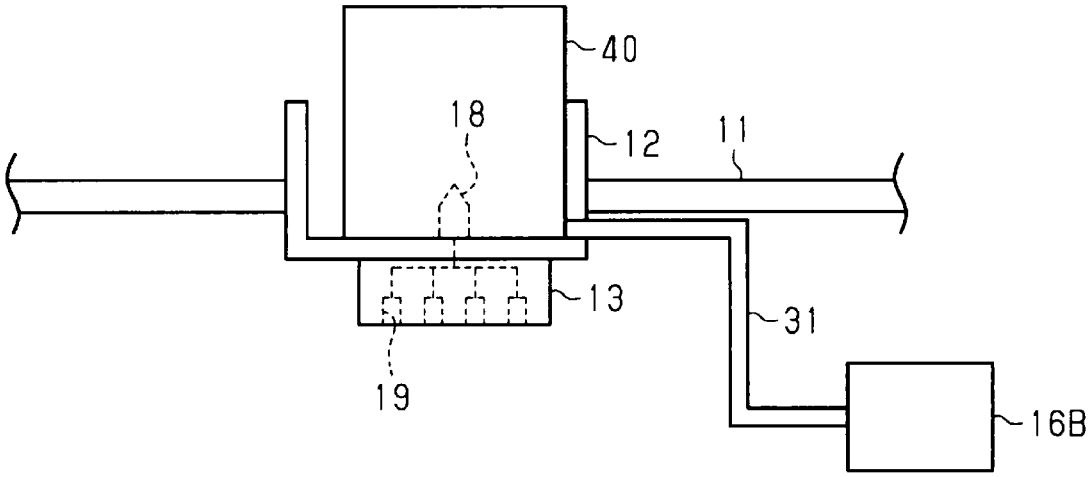

In the embodiment described above, the present disclosure may be applied to an apparatus of a type in which an adaptor 40 is mounted on the carriage 12 instead of the ink container 16 and the adaptor 40 is coupled to an ink container 16B via an ink channel 31 as illustrated in FIG. 3B. To be noted, the ink container 16B may be of a cartridge type that is replaceable, or a tank type that can be replenished with the ink through an ink pour. When the ink container 16B is of a tank type, the control unit 21 may pour the ink accommodated in the ink container 16B into the ink channel 31 extending from the ink container 16B to the printing head 13 with the ink container 16B being replenished with the ink and the remaining amount of ink becoming equal to or larger than the predetermined threshold value as a requirement after the printing mode of the printing apparatus 10 has switched from the special mode to the normal mode. In addition, the ink remainder sensor 22 may be provided in the ink container 16B, at a position adjacent to the ink container 16B in the printing apparatus 10, or at a position in the middle of the ink channel 31 extending from the ink container 16B to the printing head 13.

In the embodiment described above, the ink container 16, 16A, or 16B may include an air opening portion through which the air and the inside thereof communicate with each other.

In the embodiment described above, the predetermined cancellation operation for cancelling the special mode is not necessarily limited to an operation input by a user through the notification unit 24 including a touch panel. For example, if the printing apparatus 10 is communicably connected to a personal computer (PC) and a mobile information terminal, the user may input the predetermined cancellation operation to the control unit 21 through these terminals.

In the embodiment described above, the control unit 21 may be configured to not receive an operation for cancelling the special mode while the special mode is being executed.

In the embodiment described above, the predetermined amount may be set as a value smaller than the predetermined threshold value. In this case, even if the ink is ejected from the printing head 13 after the remaining amount of the ink accommodated in the ink container 16 has become insufficient, an air bubble is not likely to enter the ink channel extending from the ink container 16 to the printing head 13. Therefore, pouring the ink accommodated in the ink container 16 into the ink channel after replacement of the ink container 16 is not necessary.

In the embodiment described above, an additional ink remainder sensor may be provided in the ink container 16 or at a position in the middle of the ink channel extending from the ink container 16 to the printing head 13. In this case, the control unit 21 may start restricting ejection of the ink from the printing head 13 at the time when the additional ink remainder sensor detects insufficiency of the remaining amount of ink without monitoring the amount of ink ejected from the printing head 13 after the printing mode of the printing apparatus 10 has switched from the normal mode to the special mode.

In the embodiment described above, the control unit 21 may continuously perform the comparative determination between the remaining amount of ink detected by the ink remainder sensor 22 and the predetermined threshold value regardless of the printing mode of the printing apparatus 10 while the printing mode determination routine is being executed.

In the embodiment described above, ejection of the ink from the printing head 13 that is prohibited in the normal mode is not limited to printing, which is ejection of the ink toward the medium P, and may include preliminary ejection that is ejection of the ink not related to printing.

In the embodiment described above, operation prohibited in the normal mode is not limited to ejection of the ink from the printing head 13. When the printing apparatus 10 includes an maintenance device (illustration omitted) capable of performing a maintenance operation of forcibly discharging the ink from the printing head 13, the maintenance operation of the printing head 13 by the maintenance device may be prohibited in addition to the ejection of the ink from the printing head 13.

In the embodiment described above, operation allowed in the special mode is not limited to ejection of the ink from the printing head 13 toward the medium P. Preliminary ejection, which is ejection of the ink from the printing head 13 not related to printing, may be also allowed.

In the embodiment described above, when the printing apparatus 10 includes an maintenance device capable of performing a maintenance operation of forcibly discharging the ink from the printing head 13, the maintenance operation may be also allowed in the special mode. However, in the case where a plurality of the ink containers 16 accommodating different kinds of liquids are attached to the attachment portion 17 in the printing apparatus 10, there is a risk that, when ink in a channel extending from one ink container 16 to a corresponding printing head 13 is completely out, inks in channels extending from the other ink containers 16 to respective corresponding printing heads 13 cannot be efficiently discharged. Therefore, the amount of discharge from one ink container 16 during the maintenance operation may be restricted to a predetermined amount.

In the embodiment described above, the total amount of ink to be used in a plurality of operations allowed in the special mode may be set to a predetermined amount. Examples of the allowed operations include ejection of the ink from the printing head 13 to the medium P, preliminary ejection, and maintenance operation.

In the embodiment described above, when a plurality of the ink containers 16 accommodating different kinds of liquids are attached to the attachment portion 17 in the printing apparatus 10, a designation printing mode in which printing is performed with a designated kind of ink and a designation preliminary ejection mode in which preliminary ejection is performed with a designated kind of ink may be executed in the special mode. In addition, when the control unit 21 has determined that the remaining amount of ink accommodated in one ink container 16 is insufficient in this case based on a signal input from the ink remainder sensor 22, the notification unit 24 may display a display screen prompting execution of these modes. As a result of this, remainder of some kinds of ink and incapability of efficiently using the ink can be suppressed.

The printing apparatus 10 may be a line printer employing a line printing system. The printing head 13 of a line printing system is a line head having an elongated shape which is slightly longer than the maximum width of the medium P in a width direction intersecting a transport direction of the medium P, and performs printing by simultaneously ejecting the ink for one line toward the medium P being transported at a constant speed corresponding to the printing mode.

The control unit 21 may be realized by hardware, for example, by an electronic circuit such as a field-programmable gate array (FPGA) or an application specific integrated circuit (ASIC), or by cooperation of software and hardware instead of the configuration of realizing the control unit 21 by software by a computer executing a program.

The medium P is not limited to a paper sheet, and may be a film or sheet of synthetic resin, cloth, unwoven fabric, or a laminate sheet. For example, the medium P may be a medium for industrial copy printing.

Technical concepts that can be understood from the embodiments and modification examples described above will be described with the effects thereof.

Concept 1

A liquid ejecting apparatus includes a liquid ejecting head that ejects a liquid, a detection unit that detects a remaining amount of the liquid accommodated in the liquid container, and a control unit that operates in a first mode and a second mode. In the first mode, the control unit prohibits ejection of the liquid from the liquid ejecting head when the detection unit has detected that the remaining amount of the liquid accommodated in the liquid container has become smaller than a predetermined threshold value. In the second mode, the control unit allows ejection of the liquid from the liquid ejecting head with an instruction from a user as a requirement when the detection unit has detected that the remaining amount of the liquid accommodated in the liquid container has become smaller than the predetermined threshold value.

According to this configuration, even when the remaining amount of liquid is insufficient, by the switching of the operation mode of the apparatus, ejection of the liquid can be can be continuously performed by using the liquid accommodated in the liquid container, and thus the liquid can be efficiently used.

Concept 2

In the liquid ejecting apparatus according to Concept 1, the control unit may issue a notification by a notification unit to prompt an operation to transition from the first mode to the second mode when the detection unit has detected that the remaining amount of the liquid accommodated in the liquid container has become smaller than the predetermined threshold value.

According to this configuration, when the remaining amount of ink is insufficient, the user can be notified that the operation mode of the apparatus needs to be switched, and thus the operation mode can be quickly switched.

Concept 3

In the liquid ejecting apparatus according to Concept 1 or 2, the control unit may stop comparative determination between the remaining amount of the liquid detected by the detection unit and the predetermined threshold value when transition from the first mode to the second mode has occurred.

According to this configuration, processing load when the control unit executes a switching routine for the operation mode can be reduced.

Concept 4

In the liquid ejecting apparatus according to any one of Concepts 1 to 3, the control unit may set a total amount of the liquid allowed to be ejected from the liquid ejecting head to a predetermined amount when transition from the first mode to the second mode has occurred.

According to this configuration, even when the remaining amount of the liquid accommodated in the liquid container is insufficient, ejection of the liquid can be continued while avoiding ejection of the liquid from the liquid ejecting head with liquid shortage.

Concept 5

In the liquid ejecting apparatus according to Concept 4, the predetermined amount may be set as a value larger than the predetermined threshold value.

According to this configuration, the liquid remaining in the liquid container when the remaining amount of the liquid accommodated in the liquid container is insufficient can be used more efficiently.

Concept 6

In the liquid ejecting apparatus according to any one of Concepts 1 to 5, the control unit may cancel the second mode and switch to the first mode when the control unit has received a predetermined cancellation operation during the second mode.

According to this configuration, there are more opportunities to efficiently use the liquid ejecting apparatus without disposing of the liquid ejecting apparatus.

Concept 7

In the liquid ejecting apparatus according to Concept 6, the control unit may cause the liquid accommodated in the liquid container to be poured into a channel of the liquid extending from the liquid container to the liquid ejecting head with the detection unit detecting that the remaining amount of the liquid accommodated in the liquid container is equal to or larger than the predetermined threshold value as a requirement when the second mode has been cancelled and switched to the first mode.

According to this configuration, even if the liquid is ejected from the liquid ejecting head when the remaining amount of the liquid in the liquid container is insufficient and thus an air bubble enters the liquid channel extending from the liquid container to the liquid ejecting head, the air bubble can be removed from the liquid channel to maintain the accuracy of the liquid ejection.

What is claimed is:

1. A liquid ejecting apparatus comprising:

a liquid ejecting head that ejects a liquid accommodated in a liquid container;

a detection unit that detects a remaining amount of the liquid accommodated in the liquid container; and a control unit that operates in a first mode and a second mode, wherein in the first mode, the control unit prohibits ejection of the liquid from the liquid ejecting head when the detection unit detected that the remaining amount of the liquid accommodated in the liquid container became smaller than a predetermined threshold value, and in the second mode, the control unit allows ejection of the liquid from the liquid ejecting head with an instruction from a user as a requirement when the detection unit detected that the remaining amount of the liquid accommodated in the liquid container became smaller than the predetermined threshold value, the control unit sets a total amount of the liquid allowed to be ejected from the liquid ejecting head to a predetermined amount larger than the predetermined threshold value when transition from the first mode to the second mode occurred.

2. The liquid ejecting apparatus according to claim 1, wherein the control unit issues a notification by a notification unit to prompt an operation to transition from the first mode to the second mode when the detection unit detected that the remaining amount of the liquid accommodated in the liquid container became smaller than the predetermined threshold value.

3. The liquid ejecting apparatus according to claim 1, wherein the control unit stops comparative determination between the remaining amount of the liquid detected by the detection unit and the predetermined threshold value when transition from the first mode to the second mode occurred.

4. The liquid ejecting apparatus according to claim 1, wherein the control unit sets a total amount of the liquid allowed to be ejected from the liquid ejecting head to a predetermined amount when transition from the first mode to the second mode occurred.

5. The liquid ejecting apparatus according to claim 4, wherein the predetermined amount is set as a value larger than the predetermined threshold value.

6. The liquid ejecting apparatus according to claim 1, wherein the control unit cancels the second mode and switches to the first mode when the control unit received a predetermined cancellation operation during the second mode.

7. The liquid ejecting apparatus according to claim 6, wherein the detection unit detects the remaining amount of the liquid accommodated in the liquid container when the second mode was cancelled and switched to the first mode, wherein the control unit causes the liquid accommodated in the liquid container to be poured into a channel of the liquid extending from the liquid container to the liquid ejecting head under a condition that the remaining amount of the liquid accommodated in the liquid container is equal to or larger than the predetermined threshold value.

* * * * *